US006687478B2

(12) United States Patent
Sugita et al.

(10) Patent No.: US 6,687,478 B2
(45) Date of Patent: Feb. 3, 2004

(54) DEVELOPER REPLENISHING APPARATUS AND IMAGE FORMING APPARATUS PROVIDED WITH THE SAME

(75) Inventors: Satoshi Sugita, Kanagawa (JP); Kenji Matsuda, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 11 days.

(21) Appl. No.: 10/162,586

(22) Filed: Jun. 6, 2002

(65) Prior Publication Data

US 2002/0197085 A1 Dec. 26, 2002

(30) Foreign Application Priority Data

Jun. 11, 2001 (JP) ..... 2001-175819

(51) Int. Cl.[7] ..... G03G 15/08
(52) U.S. Cl. ..... 399/258; 399/260
(58) Field of Search ..... 399/258, 260

(56) References Cited

U.S. PATENT DOCUMENTS 5,237,372 A * 8/1993 Ishii et al. ..... 399/30

FOREIGN PATENT DOCUMENTS

| | | | |
|---|---|---|---|
| JP | 58-84780 | * | 5/1983 |
| JP | 4-120565 | * | 4/1992 |
| JP | 8-88748 | * | 4/1996 |

* cited by examiner

*Primary Examiner*—Quana M. Grainger
(74) *Attorney, Agent, or Firm*—Fitzpatrick, Cella, Harper & Scinto

(57) ABSTRACT

A developer replenishing apparatus including a developer container having a discharge port for discharging a developer therethrough, a screw for carrying the developer to the discharge port, a drive source for driving the screw, a motive power transmitting device for transmitting motive power from the drive source to the screw, and a rotation amount detecting device for detecting the amount of rotation of a predetermined rotary shaft in the motive power transmitting device, wherein the rotation period of the screw is an integral multiple of the rotation period of the predetermined rotary shaft.

11 Claims, 13 Drawing Sheets

FIG. 8

| GEAR NO. | NUMBER OF TEETH | ROTATING SPEED RATIO OF DRIVING SYSTEM | ROTATING SPEED RATIO OF DETECTION SHAFT / SCREW SHAFT | NOTE |
|---|---|---|---|---|
| G1 | 9 | – | – | DRIVING MOTOR |
| G2 | 64 | 1 / 7.111 | – | DETECTION SHAFT |
| | 30 | 1 / 7.111 | – | |
| G3 | 60 | 1 / 14.222 | 1 / 2.000 | |
| | 34 | 1 / 14.222 | 1 / 2.000 | |
| G4 | 63 | 1 / 26.353 | 1 / 3.706 | |
| G5 | 51 | 1 / 21.333 | 1 / 3.000 | REPLENISHING SCREW DRIVING SHAFT |
| | | | | |
| G6 | | | | |
| | | | | |
| G7 | | | | |
| | | | | |
| G8 | | | | AGITATING MEANS DRIVING SHAFT |

FIG. 9

| GEAR NO. | NUMBER OF TEETH | ROTATING SPEED RATIO OF DRIVING SYSTEM | ROTATING SPEED RATIO OF DETECTION SHAFT / SCREW SHAFT | NOTE |
|---|---|---|---|---|
| G1 | 8 | – | – | DRIVING MOTOR DETECTION SHAFT |
| G2 | 48 | 1 / 6.000 | 1 / 6.000 | |
| | 30 | 1 / 6.000 | 1 / 6.000 | |
| G3 | 60 | 1 / 12.000 | 1 / 12.000 | |
| | 34 | 1 / 12.000 | 1 / 12.000 | |
| G4 | 63 | 1 / 22.235 | 1 / 22.235 | |
| G5 | 51 | 1 / 18.000 | 1 / 18.000 | REPLENISHING SCREW DRIVING SHAFT |
| | | | | |
| G6 | | | | |
| | | | | |
| G7 | | | | |
| | | | | |
| G8 | | | | AGITATING MEANS DRIVING SHAFT |

DEVELOPER REPLENISHING APPARATUS AND IMAGE FORMING APPARATUS PROVIDED WITH THE SAME

BACKGROUND OF THE INVENTION

1. Field of the Invention

The invention relates to an image forming apparatus such as a copying machine or a printer using a recording technique of the electrophotographic type, the electrostatic recording type or the like, and a developer replenishing apparatus for use in such apparatus.

2. Description of Related Art

FIG. 10 of the accompanying drawings is a general construction view of a color image forming apparatus, which will be helpful in understanding the present invention. In the color image forming apparatus, four process cartridges 1 as image forming portions are detachably mounted on the main body A. These four process cartridges 1 are four yellow, magenta, cyan and black, respectively. A photosensitive drum 2 as an image bearing member is rotatably mounted in each process cartridge 1, and a primary charger 3, a developing portion 4, etc. are arranged along the outer periphery of the photosensitive drum, and further a cleaning portion (not shown) etc. are provided. Image exposing light of each color is applied to each photosensitive drum 2. In order to replenish the developing portion 4 of each process cartridge 1 with a developer, a developer replenishing portion 6 is detachably mounted on the main body A of the apparatus in the upper portion thereof.

A transferring portion 5 is provided in such a manner as to contact with each photosensitive drum 2. The transferring portion 5 is comprised of a primary transferring portion 8 and a secondary transferring portion 9, and the primary transferring portion 8 has an intermediate transfer belt 10, a driving roller 11 for driving the intermediate transfer belt 10 and an intermediate roller 12, and a primary transfer roller 13 disposed on the back side of the intermediate transfer belt 10 in opposed relationship with each photosensitive drum 2. Also, the secondary transferring portion 9 has a secondary transfer roller 14 and a pressure roller 15.

The main body A of the apparatus is further provided with a plurality of feed cassettes 16 containing recording materials S of respective sizes therein, and a feed portion 18 for conveying the recording materials S to a pair of registration rollers 17, and the feed portion 18 in turn is provided with a pickup roller 19 and pairs of feed rollers 20–23, and is further provided with a pair of feed rollers 24 for feeding the recording material S from an insertion port provided in the main body A of the apparatus to the pair of registration rollers 17. The main body A of the apparatus is further provided with a fixing portion 25 for fixing the recording material S conveyed from the secondary transferring portion 9, and a delivery portion 26 for delivering the fixed recording material S to a delivery tray.

Description will now be made of the process of forming a color image by the above-described image forming apparatus. Each photosensitive drum 2 rotated at a constant speed in the direction indicated by the arrows is first uniformly charged by the primary charger 3, and then image exposing light of each color is applied to the surface thereof by the whole or a part of each exposing portion 7. A latent image is formed on each image-exposed photosensitive drum 2, and those latent images are then developed in the developing portions 4 by color toners as developers. These developed images are color developed images, but in the case of monochromatic image formation, a black developed image is formed only on the photosensitive drum 2 mounted in the process cartridge 1 for black.

Next, the developed image formed on each photosensitive drum 2 is primary-transferred in the primary transferring portion 8. That is, the developed image is transferred (multilayer-transferred) onto the intermediate transfer belt 10 running at a constant speed in the direction indicated by the arrow by a primary transfer bias voltage applied to each primary transfer roller 13. The developed images transferred to the intermediate transfer belt 10 are then transferred onto the recording material S in the secondary transferring portion 9 while the recording material S passes between the secondary transfer roller 14 and the pressure roller 15. The recording material S is stopped and stands by in advance at the pair of registration rollers 17 portion, and is fed to the secondary transferring portion 9 in accordance with the transfer timing.

The recording material S to which the developed image has been transferred in the secondary transferring portion 9 is then conveyed to the fixing portion 25, where the developers thereon are fused and fixed by heat and pressure, and the recording material S is further delivered from the delivery portion 26 onto the delivery tray.

The developing portion 4 provided in each process cartridge 1 has a developer container for containing the developer therein, agitating means for agitating the contained developer and supplying it to a developing sleeve, and a developing blade for regulating the layer thickness of the developer supplied onto the developing sleeve, and the developer on the developing sleeve is supplied onto the photosensitive drum 2 opposed to the developing sleeve with a minute gap therebetween. The developer necessary for image formation fills each developer container in advance, and as the amount of developer (filling level) in the developer container is reduced by development, the developing portion 4 may be automatically replenished with the developer from the developer replenishing portion 6.

FIG. 11 of the accompanying drawings is a detailed cross-sectional view of the developer replenishing portion 6 shown in FIG. 10, and FIG. 12 of the accompanying drawings is a right side view thereof. The developer replenishing portion 6 has an elongate main body 30 serving also as a container for containing the developer T therein, and agitating means 31 having a plurality of agitating vanes is rotatably supported in the substantially central portion of the main body 30, and a replenishing screw 32 is rotatably supported in the lower portion of the main body 30. Further, a developer discharge port 33 is provided in the bottom of the main body 30 so that when the developer replenishing portion 6 is mounted on the main body A of the apparatus, the developer discharge port 33 may communicate with a supply port opening to the upper portion of the developing portion 4 which is indicated by the double-dotted line.

The replenishing screw 32 is opposite in the helix direction of the screw on the left side and right side of FIG. 11, and when the replenishing screw 32 is clockwisely rotated, the developer T is moved from left to right toward the developer discharge port 33 and is discharged therethrough.

When the developer replenishing portion 6 is mounted on the main body A of the apparatus, the end portions of the rotary shaft 34 of the agitating means 31 and the rotary shaft 35 of the replenishing screw 32 are detachably connected to driving shafts 41 and 42, respectively, in a driving portion 40 provided on the main body A side of the apparatus through couplings. In the case of connection, two guide pins 43 and 44 protruding from the driving portion 40 side are inserted into two guide cylinders protruding in parallel to each other from the end portion of the main body 30, whereby accurate positioning is accomplished.

The driving portion 40 has a driving motor 45 as a drive source, and a gear mechanism 46 connected to the output shaft of the driving motor 45. The gear mechanism 46, as shown in FIG. 12 of the accompanying drawings, comprises a plurality of gears, and the detecting shaft 48 of rotation amount detecting means 47 is connected to a second gear G2 meshing with a first gear G1 coaxially coupled to the output shaft of the driving motor 45. A fifth gear G5 having the driving shaft 42 coupled thereto meshes with the second gear G2 via a third gear G3 and a fourth gear G4, and an eighth gear G8 having the driving shaft 43 coupled thereto meshes with the fifth gear G5 via a sixth gear G6 and a seventh gear G7.

The rotation amount (phase) detecting means 47 comprises a light emitting element and a light receiving element disposed in opposed relationship with each other with a slit portion interposed therebetween, and the output signal of the light receiving element is transmitted as a detection pulse to control means 50. That is, four flags 49 are provided on the tip end portion of the detecting shaft 48 at intervals of 90°, and these flags 49 shield the slit portion of the rotation amount detecting means 47 by the rotation of the detecting shaft 48, whereby light from the light emitting element is intercepted and a pulse-like flag detection signal (detection pulse) is transmitted from the light receiving element to the control means 50. On the other hand, the fill amount of the developer in the developing portion 4 is detected by level detecting means 51, and the detection signal thereof is likewise transmitted to the control means 50.

Description will now be made of the developer replenishment control from the developer replenishing portion 6 to the developing portion 4 by the control means 50. The fill level of the developer in the developing portion 4 is always monitored by the level detecting means 51, and the detection signal thereof is transmitted to the control means 50. The control means 50 compares the detected value with a preset level, and when for example, the detected value has dropped by a predetermined amount from the set value, the control means drives the driving motor 45 so that an amount of developer corresponding to the amount of drop (deficient amount) may be supplied from the developer replenishing portion 6 to the developing portion 4.

Here, when the rotation ratio between the driving shaft 42 for rotating the replenishing screw 32 and the detecting shaft 48 of the rotation amount detecting means 47 is defined as K, if the amount of developer corresponding to the aforementioned amount of drop corresponds to the amount supplied by the replenishing screw 32 of the developer replenishing portion 6 being caused to make five revolutions, the control means 50 drive-controls the driving motor 45 until the integrated value of the number of revolutions detected by the rotation amount detecting means 47 becomes 5K.

However, in the design of a popular gear mechanism 46, the gear ratio is set to non-integral multiple in order to prevent particular gears from always meshing with each other and therefore, the rotation ratio between the detecting shaft 48 of the rotation amount detecting means 47 and the replenishing screw 32 does not become an integer. Therefore, the stop angle (phase) of the replenishing screw 32 does not become a desired angle. The amount of opening δ (see FIG. 11) formed between the screw of the replenishing screw 32 and the developer discharge port 33 is varied by the rotation phase of the screw when the replenishing screw 32 is stopped and therefore, in conformity therewith, the amount of developer supplied to the developing portion 4 becomes uneven.

Therefore, even if an attempt is made to supply the developer T in a slight amount in such a manner as to effect the rotation control of the replenishing screw 32 by one revolution (one-pitch feed: Pt in FIG. 11) or several revolutions each, the amount of one-pitch feed of the replenishing screw 32 and the phase detected by the rotation amount detecting means 47 do not coincide with each other, and this has led to the problem that when the driving and stop control of the driving motor 45 is repeated, the above-mentioned amount of error is integrated and the deviation of the amount of replenishment also becomes great.

FIG. 13 of the accompanying drawings shows the relation between the phase of one revolution (360°) of the replenishing screw 32 and the detection pulse (flag count) by the rotation amount detecting means 47. It is apparent from FIG. 13 that the detection pulse by the rotation amount detecting means 47 and the phase of one revolution of the replenishing screw 32 do not coincide with each other. Particularly, in the color image forming apparatus, the unevenness of the fill amount of developer in each developing portion 4 becomes a factor, which will cause the problem of deteriorated quality of image such as the unevenness of the hue of color of an output image or the instability of image density.

SUMMARY OF THE INVENTION

The present invention has been made in view of the above-noted problem and an object thereof is to provide a developer replenishing apparatus, which can effect highly accurate replenishment, and an image forming apparatus provided with the same.

A further object of the present invention is to provide a developer replenishing apparatus comprising:

- a developer container having a discharge port for discharging a developer therethrough;
- a screw for carrying the developer to the discharge port;
- a drive source for driving the screw;
- motive power transmitting means for transmitting motive power from the drive source to the screw; and
- rotation amount detecting means for detecting the amount of rotation of a predetermined rotary shaft in the motive power transmitting means,
- wherein the rotation period of the screw is an integral multiple of the rotation period of the predetermined rotary shaft.

Still a further object of the present invention is to provide an image forming apparatus comprising:

- an image bearing member;
- developing means for developing a latent image formed on the image bearing member;
- a container for containing therein a developer to be supplied to the developing means;
- a screw for carrying the developer to the discharge port of the container;
- a drive source for driving the screw;
- motive power transmitting means for transmitting motive power from the drive source to the screw; and
- rotation amount detecting means for detecting the amount of rotation of a predetermined rotary shaft in the motive power transmitting means,
- wherein the rotation period of the screw is an integral multiple of the rotation period of the predetermined rotary shaft.

Further objects of the present invention will become apparent from the following detailed description when read with reference to the accompanying drawings.

BRIEF DESCRIPTION OF THE DRAWINGS

FIG. 8 is a table showing the setting relations among gears constituting a gear mechanism 46, particularly gears G1–G5 and G8 relating to the present invention.

FIG. 9 is a table showing the setting relations among gears constituting a gear mechanism 46 in the second embodiment, particularly gears G1–G5 and G8 relating to the present invention.

DESCRIPTION OF THE PREFERRED EMBODIMENTS (First Embodiment)

Figure 1:
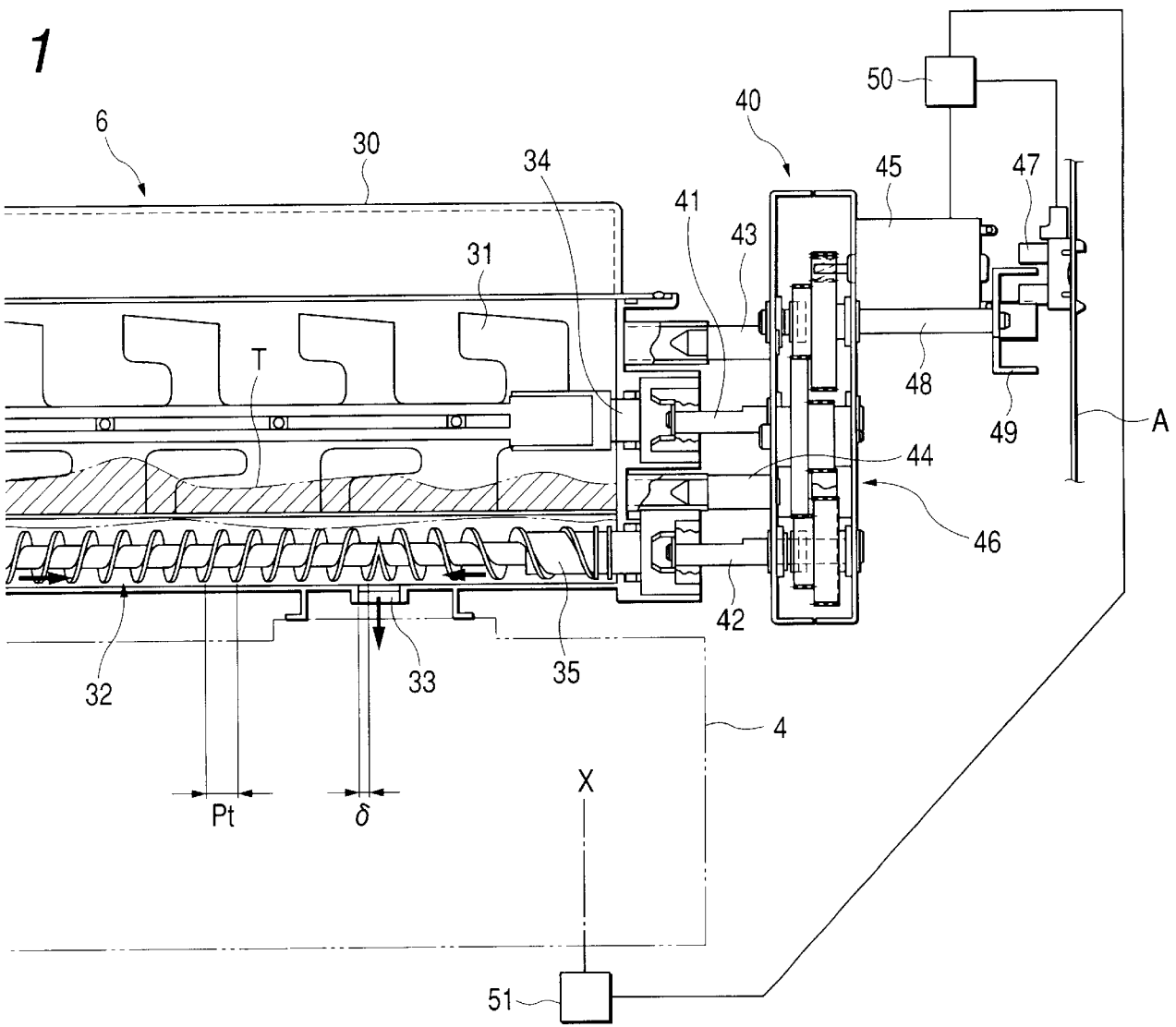
FIG. 1 is a cross-sectional view showing the essential portions of a developing portion 4 and a developer replenishing portion 6 in a first embodiment of the present invention on an enlarged scale.
Figure 2:
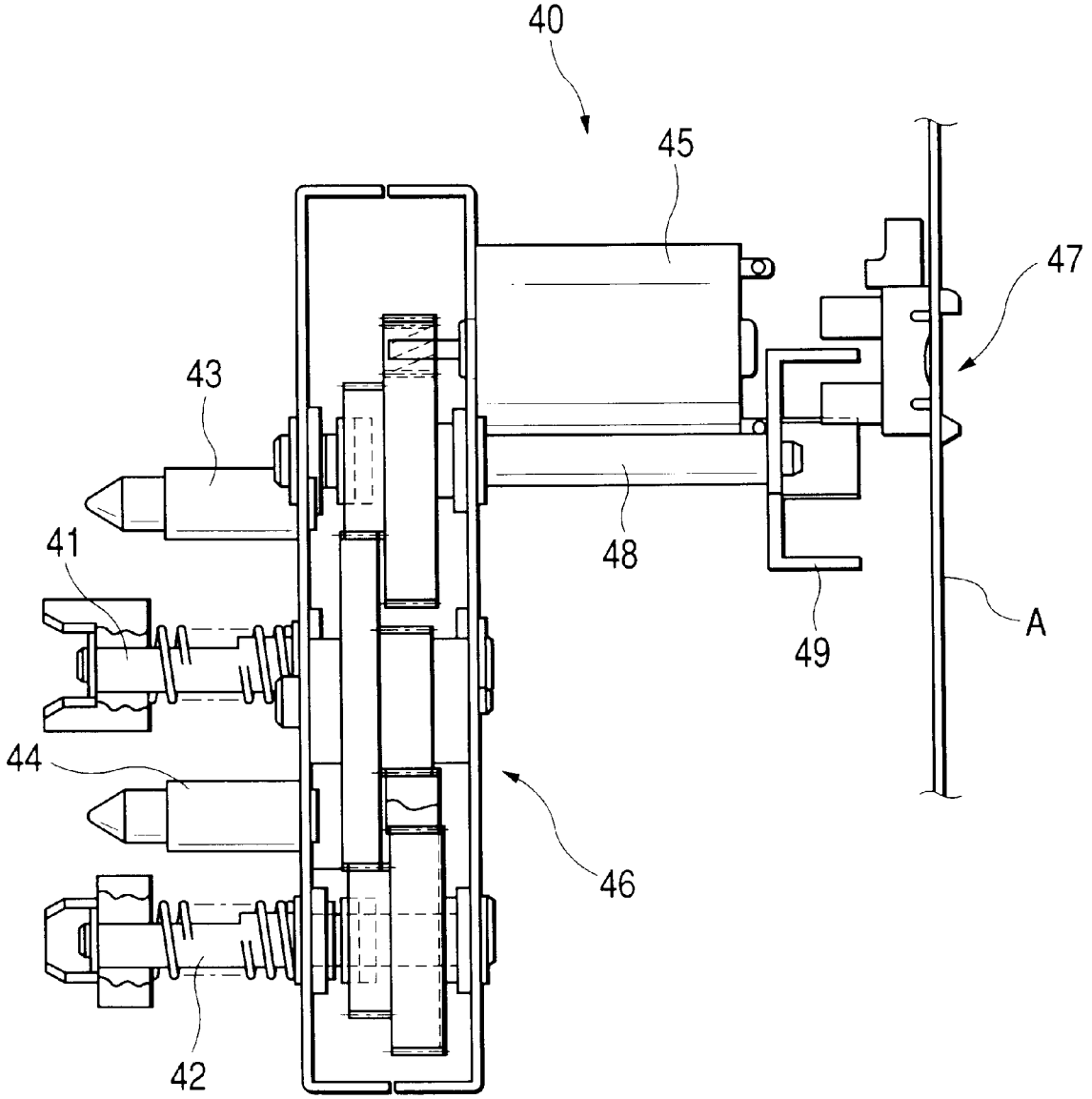
FIG. 2 is an enlarged cross-sectional view of a driving portion 40 in FIG. 1.
Figure 3:
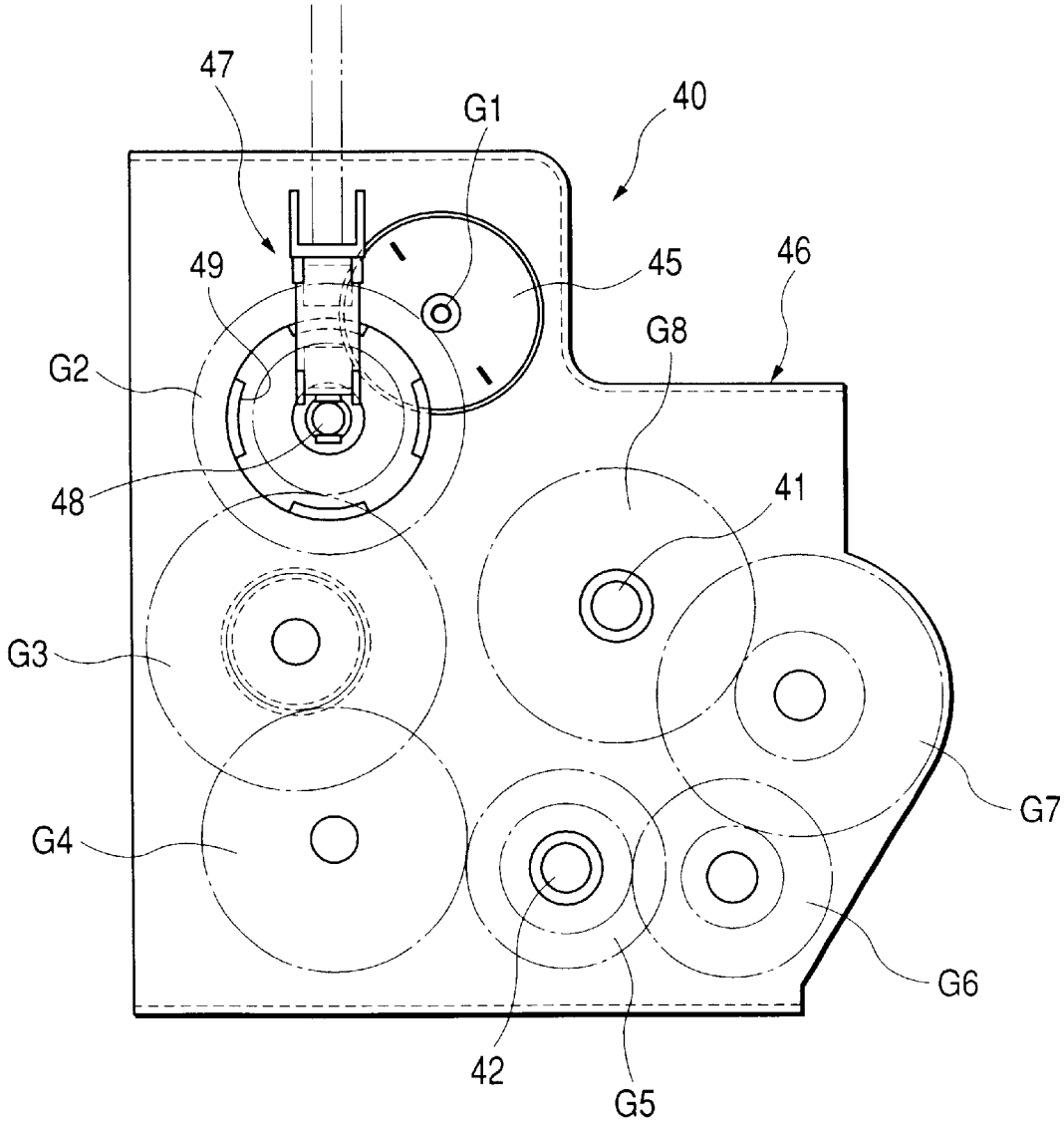
FIG. 3 is a right side view of the driving portion of FIG. 2.
Figure 4:
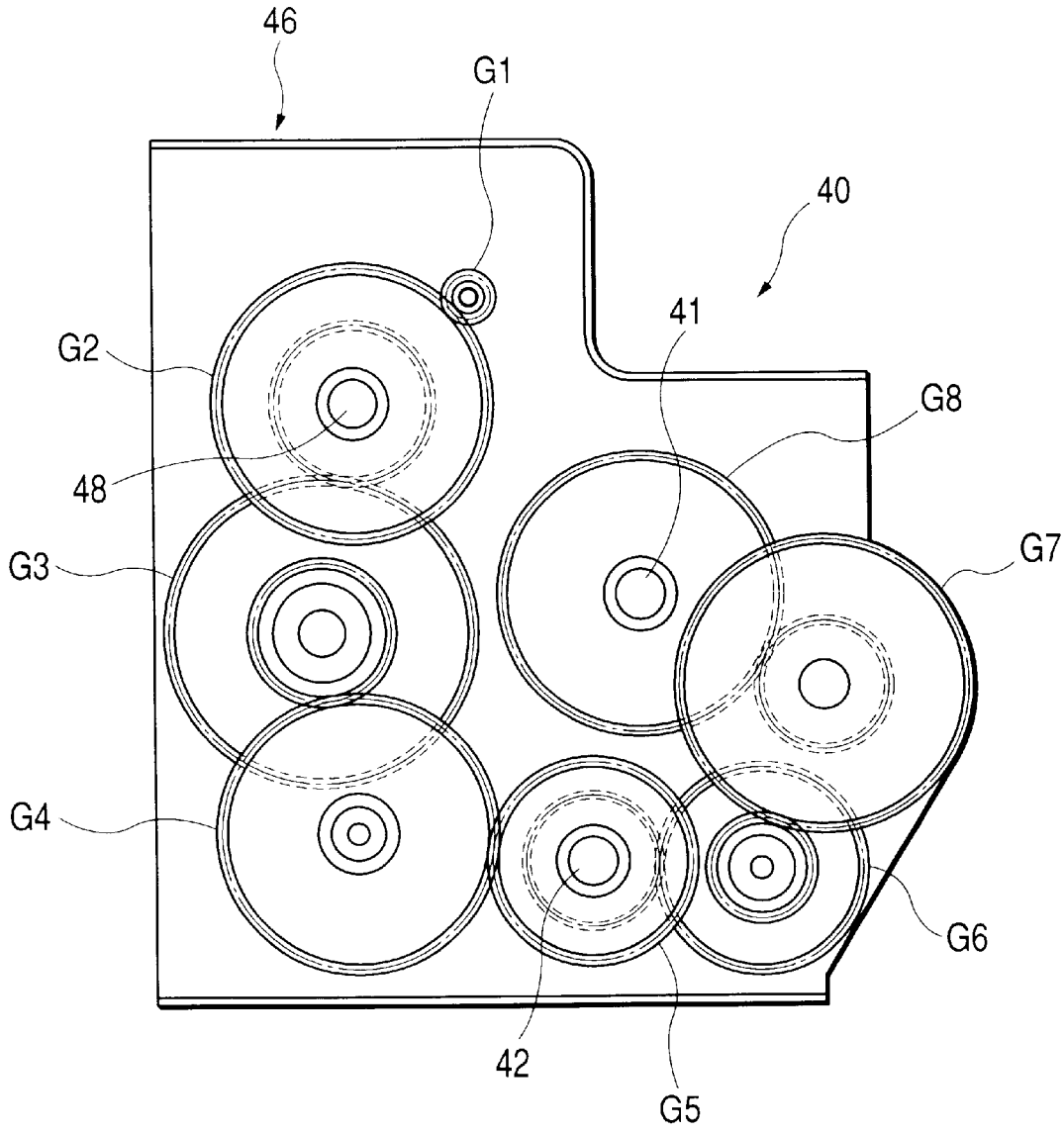
FIG. 4 is a cross-sectional view of a gear mechanism portion in FIG. 2.

A first embodiment of an image forming apparatus according to the present invention will hereinafter be described with reference to the drawings. FIG. 1 is a cross-sectional view showing the essential portions of the developing portion 4 and developer replenishing portion 6 of the image forming apparatus according to the present invention on an enlarged scale, FIG. 2 is an enlarged cross-sectional view of a driving portion 40 in FIG. 1, FIG. 3 is a right side view of the driving portion of FIG. 2, and FIG. 4 is a cross-sectional view of a gear mechanism portion in FIG. 2.

Figure 10:
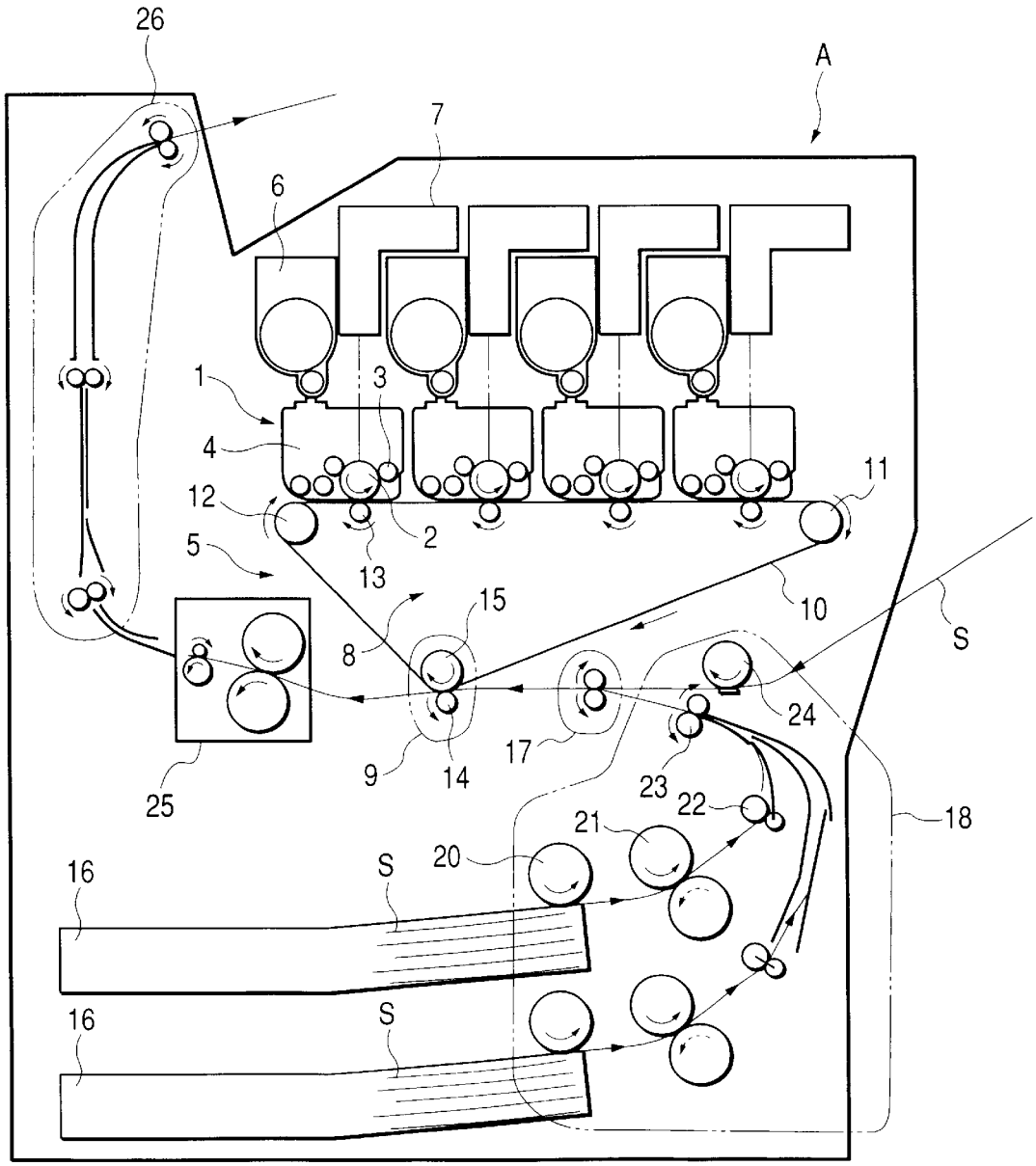
FIG. 10 shows the general construction of a popular color image forming apparatus.
Figure 11:
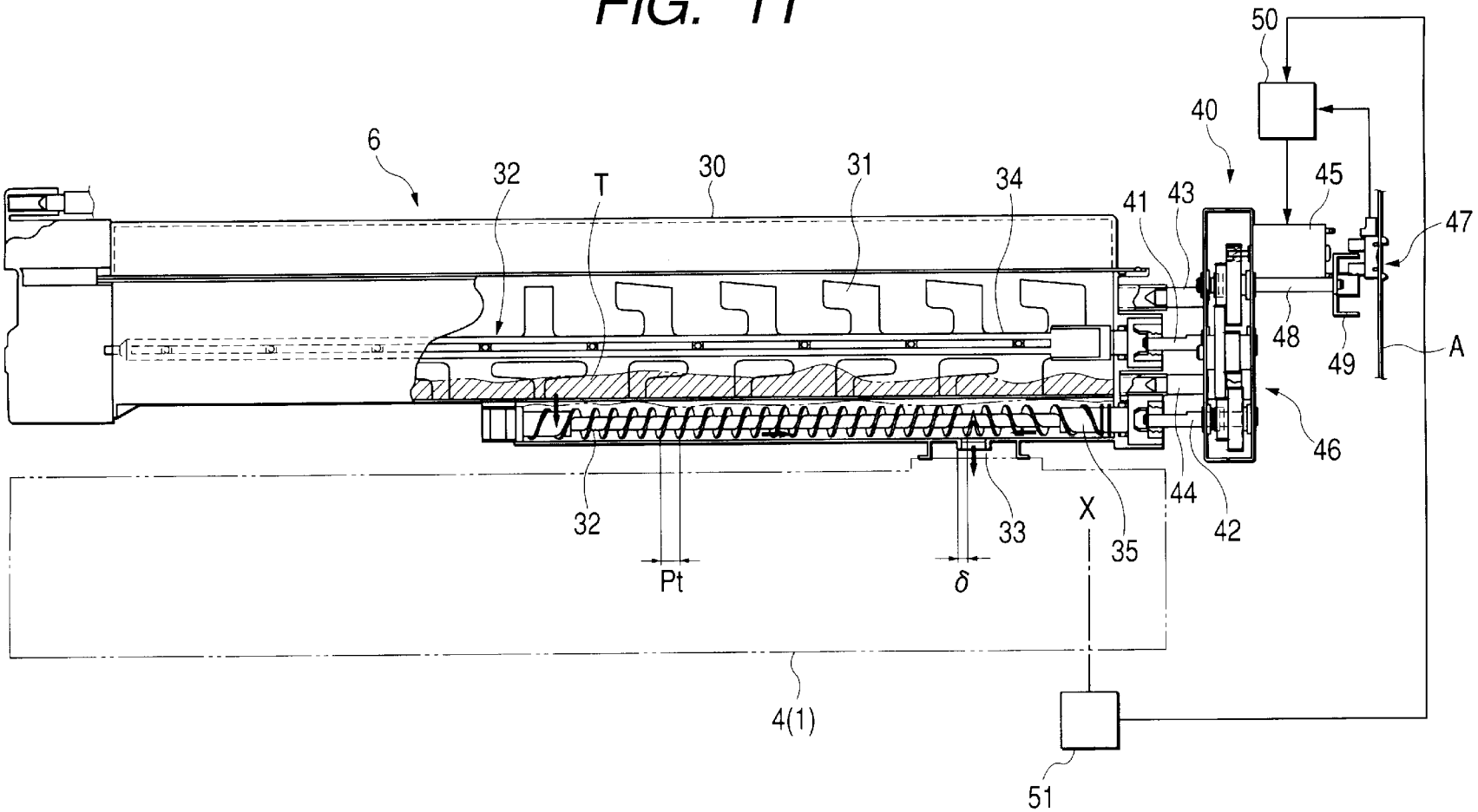
FIG. 11 is a detailed cross-sectional view of a developer replenishing portion 6 shown in FIG. 10.
Figure 12:
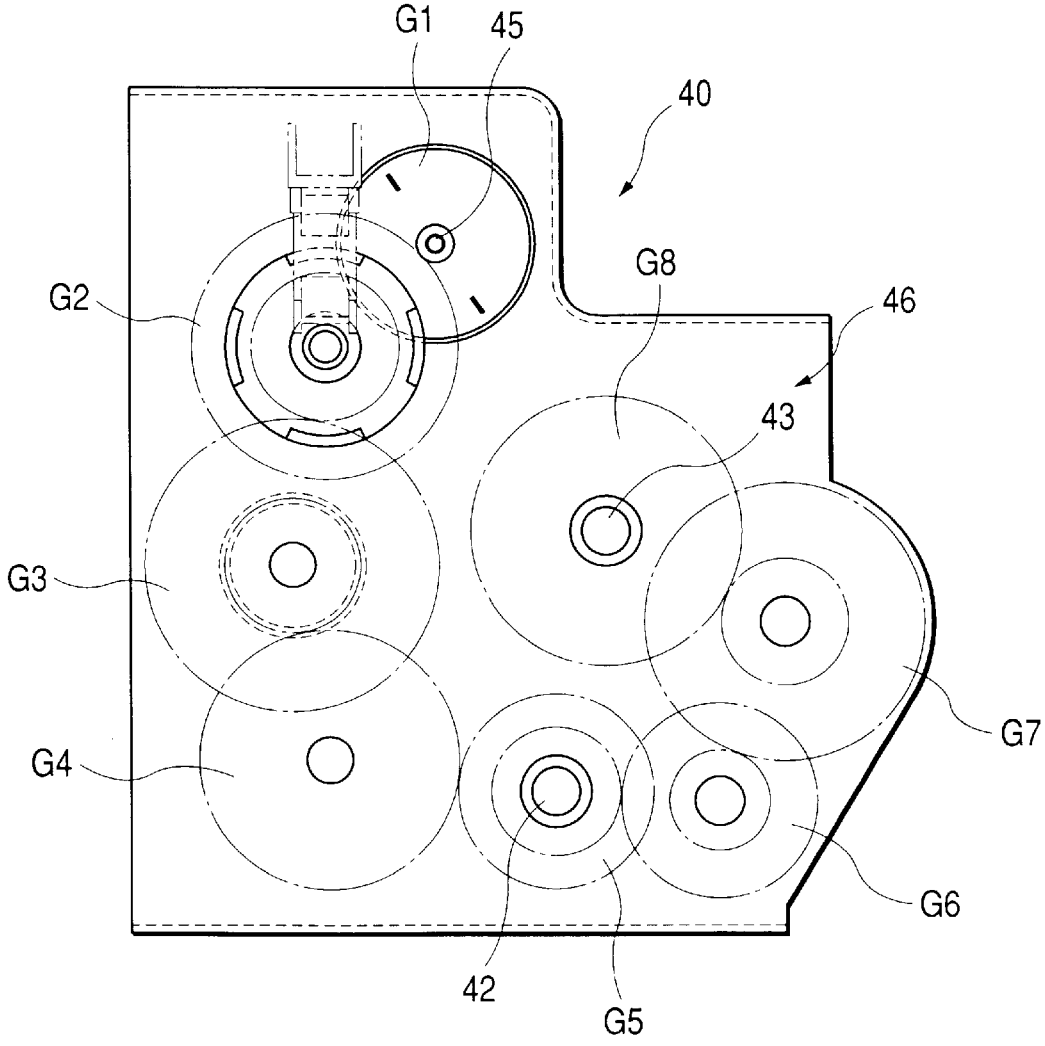
FIG. 12 is a right side view of the developer replenishing portion of FIG. 11.
Figure 13:
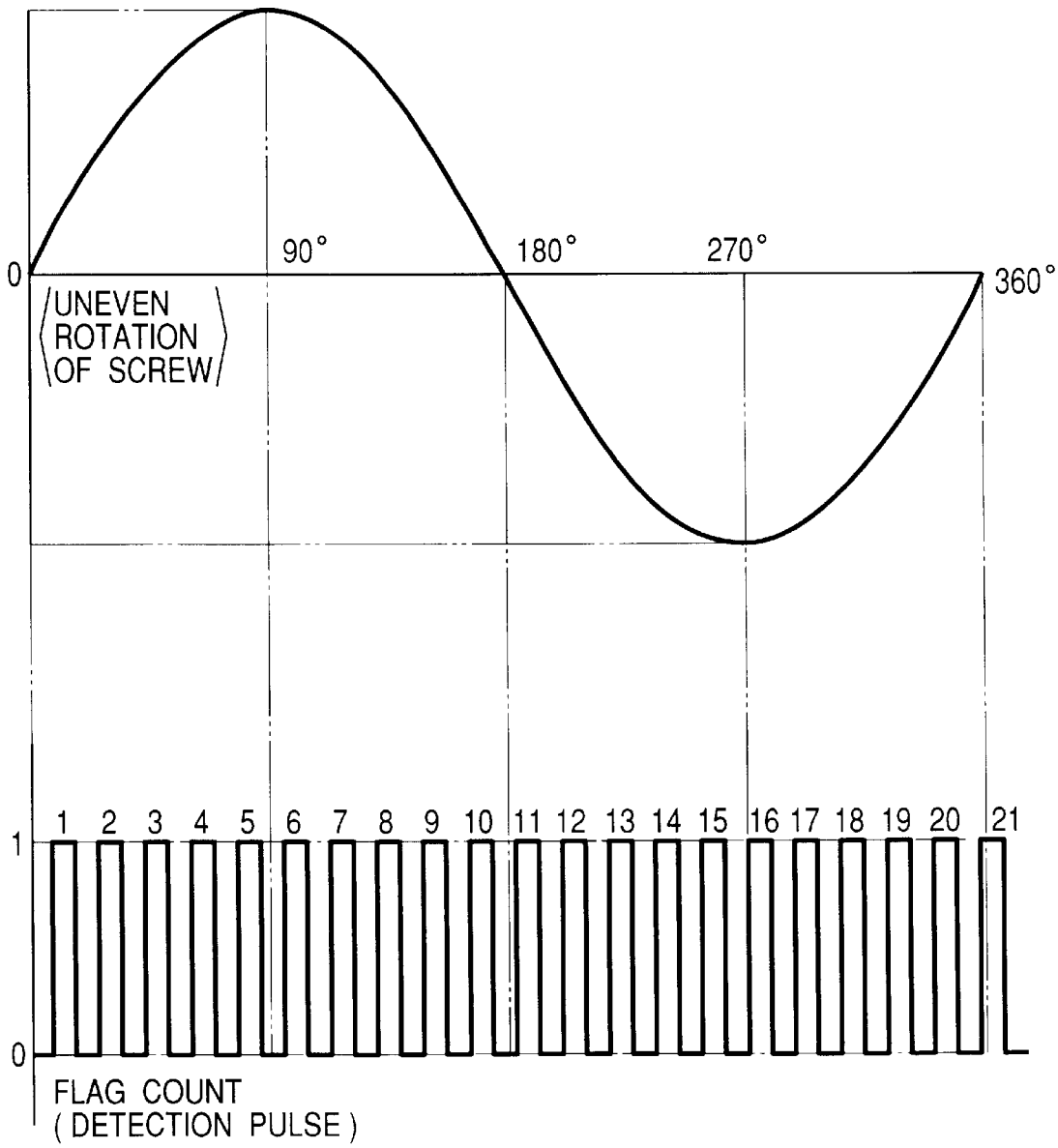
FIG. 13 shows the relation between the phase of one revolution (360°) of a replenishing screw 32 in FIG. 11 and a detection pulse (flag count) by rotation amount detecting means 47.

The general construction of the image forming apparatus according to the present embodiment is similar to that shown in FIG. 10, and a developing portion 4 and the main body 30 portion of a developer replenishing portion 6 are similar to those shown in FIG. 11. Also, regarding a driving portion 40 shown in FIGS. 2 to 4, the basic construction thereof is similar to that shown in FIGS. 11 and 12, except the gear ratio thereof. Accordingly, in these figures, the same portions as those in FIGS. 10 to 12 are given the same reference characters.

In FIG. 1, agitating means 31, a replenishing screw 32 as replenishing means and a developer discharge port 33 are provided in the main body (replenishing container) 30 of the developer replenishing portion 6, and with the developer replenishing portion 6 mounted on the main body A of the apparatus, the developer discharge port 33 communicates with a supply port opening to the upper portion of the developing portion 4 in a process cartridge 1 indicated by the double-dotted line. The replenishing screw 32, as in FIG. 11, is opposite in the helix direction of the screw on the left side and the right side, and when the replenishing screw 32 is clockwisely rotated, a developer T moves from left to right toward the developer discharge port 33 as indicated by the arrows, and the amount of discharge from the developer discharge port per one revolution of the replenishing screw is always constant.

When the developer replenishing portion 6 is mounted on the main body A of the apparatus, the end portions of the rotary shaft 34 of the agitating means 31 and the rotary shaft 35 of the replenishing screw 32 are connected to driving shafts 41 and 42, respectively, in the driving portion 40 provided on the main body A side of the apparatus through couplings. As guide means in case of connection, two guide cylinders protruding in parallel to each other from the main body 30 of the replenishing container and two guide pins 43 and 44 protruding from the driving portion 40 side in opposed relationship therewith are provided and accurate positioning is done. These guide pins 43 and 44 act also as a supporting mechanism for one axial side of the main body 30 of the replenishing container.

The driving portion 40 has a driving motor 45 as a drive source, and a gear mechanism (drive transmitting means) 46 as a drive coupling mechanism connected to the output shaft of the driving motor. The gear mechanism 46, as shown in FIGS. 2 to 4, comprises a plurality of gears, and the detecting shaft (predetermined rotary shaft) 48 of rotation amount detecting means 47 is connected to a second gear G2 meshing with a first gear G1 coaxially coupled to the output shaft of the driving motor 45. A fifth gear G5 having the driving shaft 42 coupled thereto meshes with the second gear G2 via a third gear G3 and a fourth gear G4, and an eighth gear G8 having the driving shaft 41 coupled thereto meshes with the fifth gear G5 via a sixth gear G6 and a seventh gear G7.

The rotation amount detecting means 47 comprises a light emitting element and a light receiving element disposed in opposed relationship with each other with a slit portion interposed therebetween, and the output signal of the light receiving element is transmitted to control means 50. Four flags 49 are provided on the tip end portion of the detecting shaft 48 at intervals of 90°, and those flags 49 shield the slit portion of the rotation amount detecting means 47 by the rotation of the detecting shaft 48, whereby light from the light emitting element is intercepted and a pulse-like flag detection signal is transmitted from the light receiving element to the control means 50.

On the other hand, the fill amount of developer in the developing portion 4 is detected by level detecting means 51, and the detection signal thereof is transmitted to the control means 50. As the level detecting means 51, use can be made, for example, of a detecting device of the optical type, the inductance type, the electrostatic capacity type or like type. The control means 50 is comprised, for example, of a microcomputer device provided with a CPU (central processing unit), a storing portion and an input/output portion, and a thyristor driving portion or the like for amplifying the control signal of the control means and driving the driving motor 45.

In the present embodiment, a two-component developer having a toner and a carrier is contained in the developing portion 4, and the level detecting means 51 detects the density of the toner in the developing portion 4. The toner only is contained in the replenishing container.

In the present embodiment, the detecting shaft 48 of the rotation amount detecting means 47 is coupled to the gear G2 meshing with the gear G1 of the driving motor 45. Each time this detecting shaft 48 makes one revolution, the four flags 49 shields the space between the light emitting element and the light receiving element in the rotation amount detecting means 47, whereby four detection pulses per one revolution are transmitted to the control means 50. On the other hand, the present invention, as previously described, has a feature in that the gear ratio of the gear mechanism 46 is set so that the rotation periods of the detecting shaft 48 of the rotation amount detecting means 47 and the replenishing screw 32 may be at an integral ratio, that is, the rotation period of the replenishing screw may be an integral multiple of (integer times as great as) the rotation period of the detecting shaft.

FIG. 8 shows the setting relations among the gears constituting the gear mechanism 46, particularly the gears G1–G5 and G8 relating to the present invention. As can be seen from FIG. 8, in the present embodiment, the reduction gear ratio between the gear G2 for rotating the detecting shaft 48 and the gear G5 for rotating the replenishing screw 32 is set to 3.00, and the rotating speed ratio between the two shafts is 1/3. Accordingly, the detecting shaft 48 makes just three revolutions for one revolution of the replenishing screw 32 and thus, the rotation period of the replenishing screw is three times as great as the rotation period of the detecting shaft, and 3×4=12 detection pulses are outputted.

Description will now be made of the operation of the above-described image forming apparatus, and particularly the developer replenishment control of the developing portion 4. When for example, the level detecting means (in the present embodiment, density detecting means) 51 shown in FIG. 1 detects the drop of the developer level (toner density) in the developing portion 4, the detection signal thereof is transmitted to the control means 50. In response to it, the control means 50 calculates the amount of rotation of the screw for recovering the developer level (density level) in the developing portion 4 to a set value. When for example, it is judged that the developing portion 4 can be replenished with an amount of developer corresponding to one revolution of the replenishing screw 32, the driving motor 45 is first driven to thereby start the supply of the developer T by the replenishing screw 32.

The detecting shaft 48 of the rotation amount detecting means 47 is rotated by the driving of the driving motor 45, and with the rotation thereof, the detection pulses are fed back to the control means 50. When the number of the detection pulses has reached 12 (twelve pulses), that is, when the replenishing screw 32 has made one revolution, the control means 50 stops the driving motor 45. Thereby, the replenishing screw 32 accurately makes one revolution and then is stopped and therefore, the amount of developer supplied to the developing portion 4 is accurately controlled.

Figure 5:
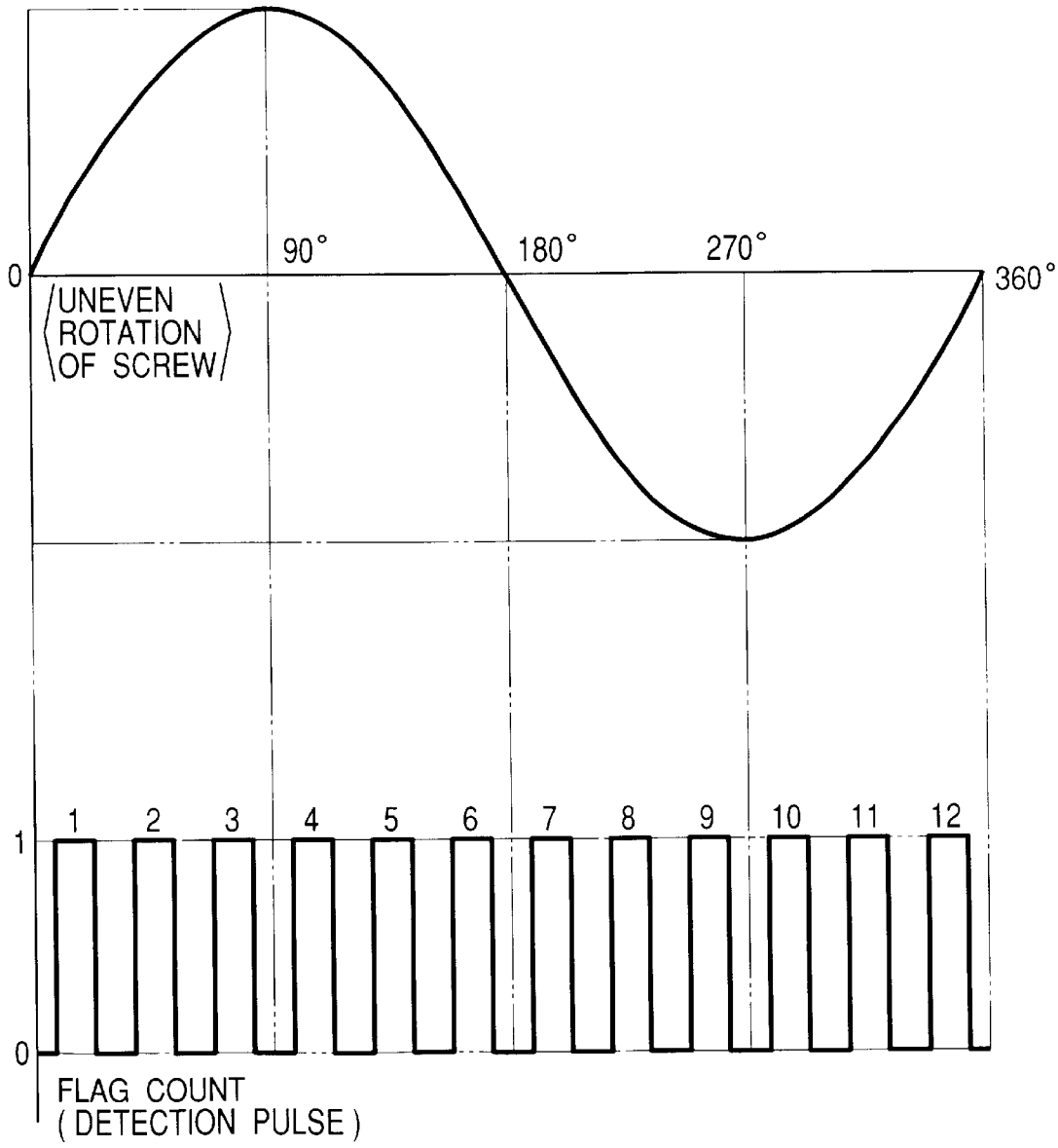
FIG. 5 shows the relation between the phase of one revolution (360°) of a replenishing screw 32 and a detection pulse (flag count) by rotation amount detecting means 47, in the first embodiment.

FIG. 5 shows the relation between the phase of one revolution (360°) of the replenishing screw 32 and the detection pulse (flag count) by the rotation amount detecting means 47. It is apparent from FIG. 5 that the detection pulse by the rotation amount detecting means 47 and the phase of one revolution of the replenishing screw 32 coincide with each other. Particularly in the color image forming apparatus, the amount of supply of the developer in each developing portion 4 can be accurately controlled and therefore, the amount of developer supplied to the photosensitive drum 2 becomes stable and it can be avoided to cause the problem of deteriorated quality of image such as the unevenness of the hue of color or the instability of image density.

(Second Embodiment)

Figure 6:
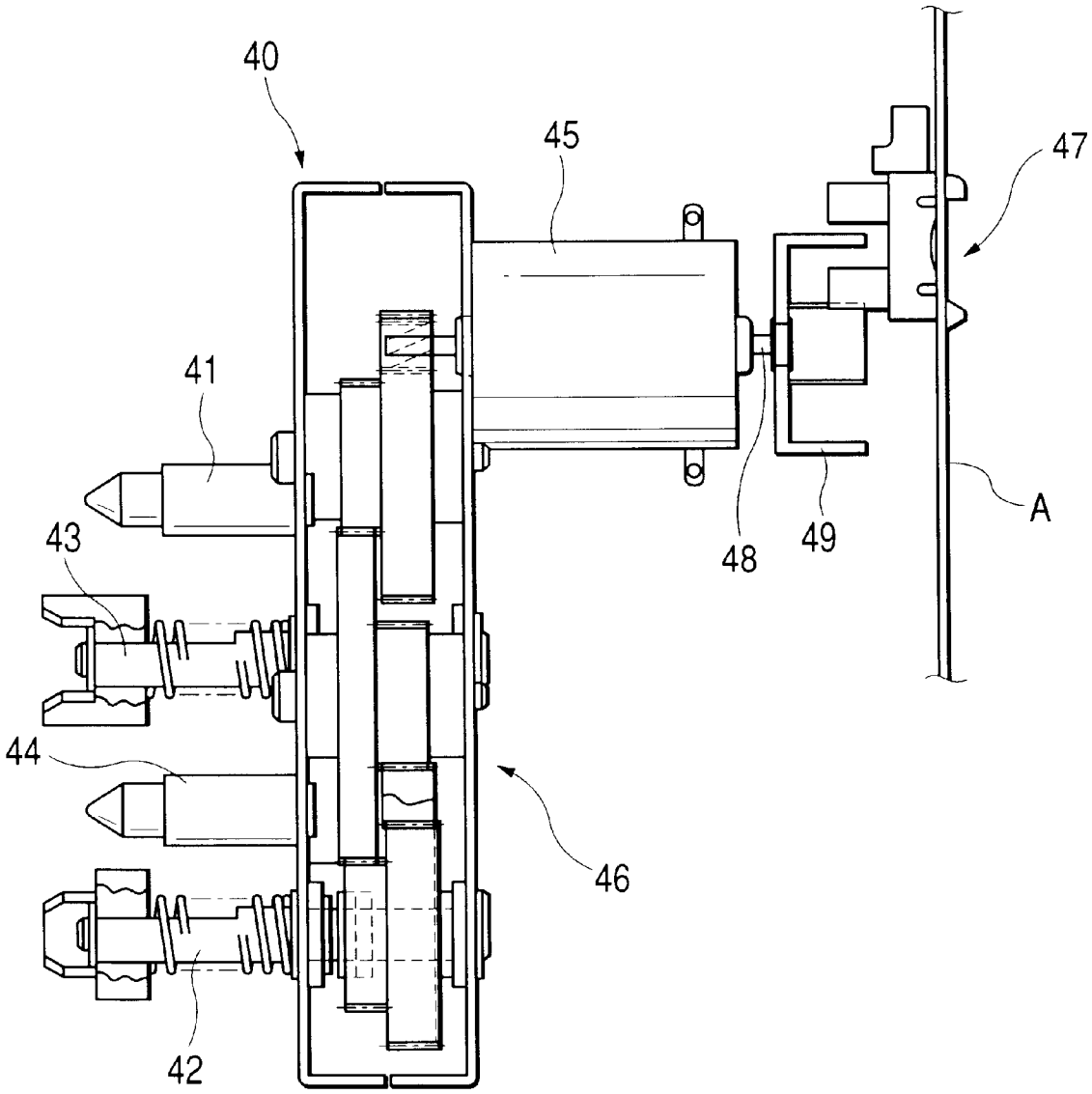
FIG. 6 is a cross-sectional view of a driving portion 40 in a second embodiment.
Figure 7:
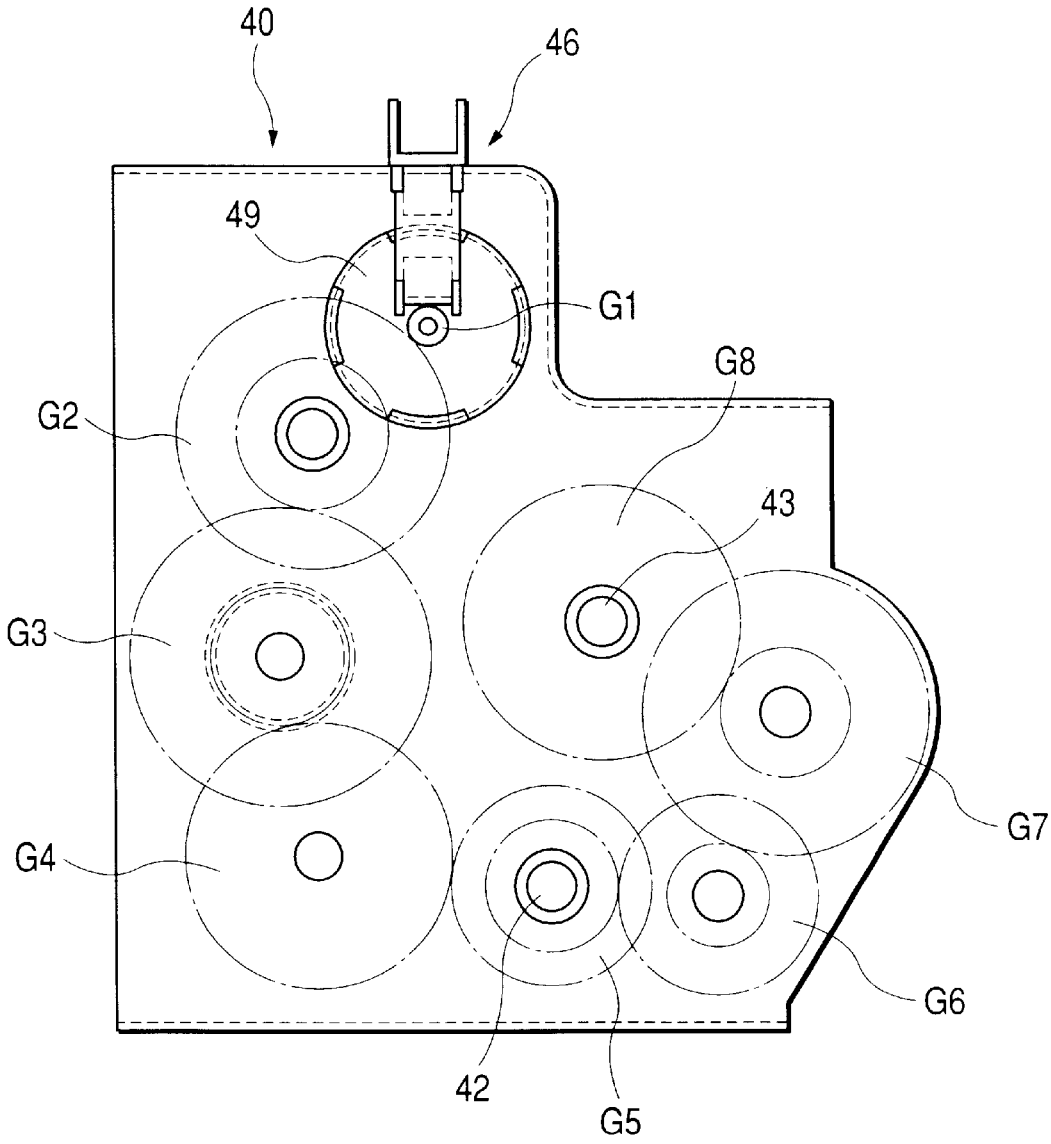
FIG. 7 is a right side view of the driving portion of FIG. 6.

FIG. 6 is a cross-sectional view of a driving portion 40 in a second embodiment, and FIG. 7 is a right side view of the driving portion of FIG. 6. These figures are drawn correspondingly to FIGS. 2 and 3 which show the first embodiment, and the same portions as those in FIGS. 2 and 3 are given the same reference characters.

The difference of this second embodiment from the first embodiment is that use is made of a driving motor 45 of such structure in which output shafts protrude from the both sides of the main body and the detecting shaft 48 of the rotation amount detecting means 47 is coaxially directly connected to one of the output shafts, and in the other points, the second embodiment is the same as the first embodiment. Accordingly, the general construction of the image forming apparatus, the developer replenishing portion 6, the control system, etc. in the second embodiment are similar to those in the first embodiment and therefore, they need not be described.

When as described above, the detecting shaft 48 is coaxially directly connected to the output shaft of the driving motor 45, the rotation ratio between the detecting shaft 48 of the rotation amount detecting means 47 and the replenishing screw 32 can be made great (of course, an integral ratio) and therefore, the developer replenishment control by the replenishing screw 32 can be effected with higher accuracy, namely, with higher resolving power.

FIG. 9 shows the setting relations among gears constituting a gear mechanism 46 in the second embodiment, particularly gears G1–G5 and G8 relating to the present invention. As will be seen from FIG. 9, in the present embodiment, the reduction gear ratio between the output shaft of the driving motor 45 for rotating the detecting shaft 48 and the gear G5 for rotating the replenishing screw 32 is set to 18.00, and the rotating speed ratio between the two shafts is 1/18. Accordingly, 18×4=72 detection pulses are outputted for one revolution of the replenishing screw 32.

The present invention is not restricted to the above-described embodiments, but covers modifications within the technical idea thereof.

What is claimed is:

1. A developer replenishing apparatus comprising:

a developer container having a discharge port for discharging a developer therethrough;

a screw for carrying the developer to the discharge port;

a drive source for driving said screw;

motive power transmitting means for transmitting motive power from said drive source to said screw; and rotation amount detecting means for detecting an amount of rotation of a predetermined rotary shaft in said motive power transmitting means, wherein a rotation period of said screw is an integral multiple of a rotation period of said predetermined rotary shaft.

2. A developer replenishing apparatus according to claim 1, wherein said motive power transmitting means comprises reduction gears.

3. A developer replenishing apparatus according to claim 1, further comprising control means for controlling said drive source so that said predetermined rotary shaft is rotated by a target amount.

4. A developer replenishing apparatus according to claim 1, wherein a plurality of flags are attached to said predetermined rotary shaft, and said rotation amount detecting means detects a number of passages of said plurality of flags.

5. An image forming apparatus comprising:

an image bearing member;

developing means for developing a latent image formed on said image bearing member;

a container for containing a developer to be supplied to said developing means;

a screw for carrying the developer to a discharge port of said container;

a drive source for driving said screw;

motive power transmitting means for transmitting motive power from said drive source to said screw; and rotation amount detecting means for detecting an amount of rotation of a predetermined rotary shaft in said motive power transmitting means, wherein a rotation period of said screw is an integral multiple of a rotation period of said predetermined rotary shaft.

6. An image forming apparatus according to claim 5, wherein said motive power transmitting means comprises reduction gears.

7. An image forming apparatus according to claim 5, further comprising control means for controlling said drive source so that said predetermined rotary shaft is rotated by a target amount.

8. An image forming apparatus according to claim 7, wherein said control means sets the target amount so that a density of the developer in said developing means maintains a set density.

9. An image forming apparatus according to claim 5, wherein a plurality of flags are attached to said predetermined rotary shaft, and said rotation amount detecting means detects a number of passages of said plurality of flags.

10. An image forming apparatus according to claim 5, wherein said container is detachably mountable on a main assembly of said image forming apparatus.

11. An image forming apparatus according to claim 10, wherein said screw is integral with said container and is detachably mountable on the main assembly of said image forming apparatus.

* * * * *

UNITED STATES PATENT AND TRADEMARK OFFICE

CERTIFICATE OF CORRECTION

PATENT NO. : 6,687,478 B2
DATED : February 3, 2004
INVENTOR(S) : Satoshi Sugita et al.

It is certified that error appears in the above-identified patent and that said Letters Patent is hereby corrected as shown below:

Column 1,
Line 19, “four” (second occurrence) should be deleted; and
Line 25, “are” should read -- is --.

Column 6,
Line 11, “clockwisely” should read -- clockwise --.

Column 7,
Line 10, “shields” should read -- shield --.

Signed and Sealed this

Twenty-second Day of June, 2004

JON W. DUDAS
*Acting Director of the United States Patent and Trademark Office*